US007950797B2

(12) United States Patent
Fujita et al.

(10) Patent No.: US 7,950,797 B2
(45) Date of Patent: May 31, 2011

(54) IMAGE FORMING APPARATUS

(75) Inventors: Akihiro Fujita, Kanagawa (JP); Shinichiro Naruse, Kanagawa (JP); Yohzoh Dohki, Aichi (JP)

(73) Assignee: Ricoh Company. Ltd., Tokyo (JP)

( * ) Notice: Subject to any disclaimer, the term of this patent is extended or adjusted under 35 U.S.C. 154(b) by 85 days.

(21) Appl. No.: 12/326,626

(22) Filed: Dec. 2, 2008

(65) Prior Publication Data

US 2009/0147066 A1 Jun. 11, 2009

(30) Foreign Application Priority Data

Dec. 6, 2007 (JP) ..... 2007-316166

(51) Int. Cl.
*B41J 2/01* (2006.01)

(52) U.S. Cl. ..... 347/104

(58) Field of Classification Search ..... 347/101, 347/104

See application file for complete search history.

(56) References Cited

U.S. PATENT DOCUMENTS

| | | | | |
|---|---|---|---|---|
| 7,434,928 | B2 | 10/2008 | Dohki | |
| 2005/0146554 | A1 | 7/2005 | Asanuma et al. | |
| 2005/0194730 | A1 | 9/2005 | Nishida et al. | |
| 2006/0061645 | A1 * | 3/2006 | Dohki | 347/104 |
| 2006/0146106 | A1 | 7/2006 | Naruse | |
| 2006/0209104 | A1 | 9/2006 | Naruse | |
| 2006/0268053 | A1 | 11/2006 | Naruse | |
| 2007/0126787 | A1 | 6/2007 | Naruse | |

FOREIGN PATENT DOCUMENTS

| | | | |
|---|---|---|---|
| JP | 2000037916 A | * | 2/2000 |
| JP | 2003-175648 | | 6/2003 |
| JP | 2006-111002 | | 4/2006 |
| JP | 2006-159664 | | 6/2006 |
| JP | 2007-276220 | | 10/2007 |

* cited by examiner

*Primary Examiner* — Matthew Luu
*Assistant Examiner* — Kendrick X Liu
(74) *Attorney, Agent, or Firm* — Cooper & Dunham LLP

(57) ABSTRACT

A disclosed image forming apparatus includes a recording head configured to eject liquid droplets onto a sheet to form an image; a transport unit configured to intermittently transport the sheet; a discharge transport unit disposed downstream the transport unit in a transport direction, the discharge transport unit including plural transport rollers configured to transport the sheet in a sheet discharge direction and plural spurs disposed facing the respective transport rollers and arranged in the transport direction; a guide member configured to hold the spurs and be rotatable about a most downstream side or a most upstream side in the transport direction to rotate in a direction away from a sheet transport path; and a stopping and holding unit configured to stop and hold the guide member in a position in which only the spur in the most downstream side in the transport direction is in contact with the sheet.

13 Claims, 10 Drawing Sheets

IMAGE FORMING APPARATUS

BACKGROUND

1. Technical Field

This disclosure relates to an image forming apparatus including a recording head that ejects liquid droplets.

2. Description of the Related Art

Image forming apparatuses (e.g. printers, fax machines, copiers, and multifunction machines having functions of these machines) are known that perform image formation by ejecting liquid (recording liquid) such as ink onto a medium using, for example, a liquid ejection device while transporting the medium. The liquid ejection device comprises a recording head including a liquid ejection head (liquid droplet ejection head) for ejecting droplets of the recording liquid (ink). It is to be noted that the term "medium" as used herein is hereinafter also referred to as a "sheet", which may be paper or may be made of other materials. The terms "to-be-recorded medium", "recording medium", "transfer material", and "recording sheet", may be used as synonyms. The terms "recording", "printing", and "imaging" may be used as synonyms for the term "image formation".

The term "image forming apparatus" as used herein indicates an apparatus that forms images by ejecting liquid onto media such as paper, strings, fibers, cloth, leather, metal, plastic, glass, wood, and ceramics. The term "image formation" as used herein indicates not only forming images that have meanings, such as characters and figures, on a medium, but also forming images that do not have meanings, such as patterns, on a medium (i.e., merely ejecting liquid droplets onto a medium). The image forming apparatus may include a textile printing apparatus and an apparatus for printing interconnects. The term "ink" as used herein is not limited to recording liquid, but includes any liquid that can be used for image formation.

One such image forming apparatus, as disclosed in Japanese Patent Laid-Open Publication No. 2006-111002 (Patent Document 1), comprises a recording head configured to eject liquid droplets onto a sheet to form an image; a transport unit configured to intermittently transport the sheet so that the sheet is transported facing the recording head; plural transport rollers disposed downstream the transport unit in a sheet transport direction and configured to transport the sheet in a sheet discharge direction; and plural spurs disposed facing the respective transport rollers and arranged in the sheet transport direction. A guide member is configured to hold the plural spurs and is displaceable between an open position for opening a transport path and a guide position for guiding the sheet. The guide member includes a protection member that is displaceable between a protection position for protecting the spurs and a retracted position retracted from the protection position.

Japanese Patent Laid-Open Publication No. 2007-276220 (Patent Document 2), Japanese Patent Laid-Open Publication No. 2003-175648 (Patent Document 3), and Japanese Patent Laid-Open Publication No. 2006-159664 (Patent Document 4) also disclose image forming apparatuses using spurs.

In the case where a sheet with an image formed is transported while being pressed by a spur, the spur often scratches off the ink on the image formation surface to form a white dotted line. If a sheet is pressed by plural spurs arranged in the sheet transport direction as in the image forming apparatus of Patent Document 1, the resulting white dotted line is more noticeable due to contact with the increased number of spurs.

In the case of reversing a sheet and discharging the reversed sheet into a tray inside the apparatus body, the required transporting force is greater than the transporting force required in the case of discharging the sheet straight ahead, and therefore the image forming apparatus needs to have plural spurs in the sheet transport direction. Such an image forming apparatus tends to form noticeable spur traces.

BRIEF SUMMARY

According to an aspect of this disclosure, there is provided an image forming apparatus that includes a recording head configured to eject liquid droplets onto a sheet to form an image; a transport unit configured to intermittently transport the sheet so that the sheet is transported facing the recording head; a discharge transport unit disposed downstream the transport unit in a sheet transport direction, the discharge transport unit including plural transport rollers configured to transport, independently from the transport unit, the sheet in a sheet discharge direction and plural spurs disposed facing the respective transport rollers and arranged in the sheet transport direction; a guide member configured to hold the spurs of the discharge transport unit and be rotatable about a most downstream side or a most upstream side in the sheet transport direction to rotate in a direction away from a sheet transport path; and a stopping and holding unit configured to stop and hold the guide member in a position in which only the spur in the most downstream side in the sheet transport direction is in contact with the sheet.

The aforementioned image forming apparatus includes the guide member configured to hold the spurs of the discharge transport unit and be rotatable about a most downstream side or a most upstream side in the sheet transport direction to rotate in a direction away from a sheet transport path, and a stopping and holding unit configured to stop and hold the guide member in a position in which only the spur in the most downstream side in the sheet transport direction is in contact with the sheet. Therefore, in the case of forming an image on which noticeable spur traces tend to be formed, the number of spurs that come into contact with the sheet can be reduced. Thus, although plural spurs are arranged in the sheet transport direction, it is possible to make spur traces less noticeable.

DETAILED DESCRIPTION OF THE PREFERRED EMBODIMENT

Figure 1:
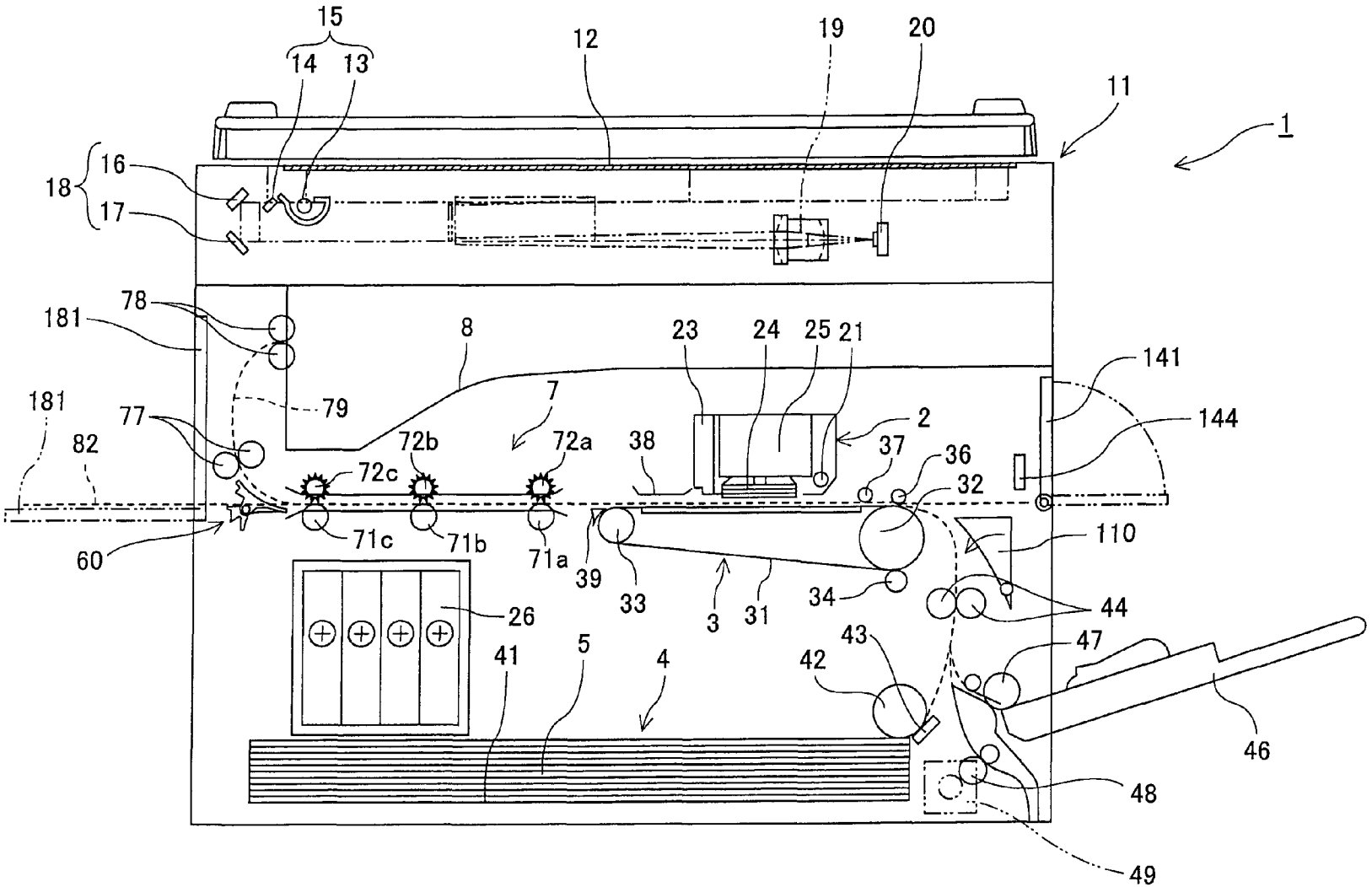
FIG. 1 is a schematic configuration diagram illustrating an example of an image forming apparatus according to an embodiment of the present invention.
Figure 2:
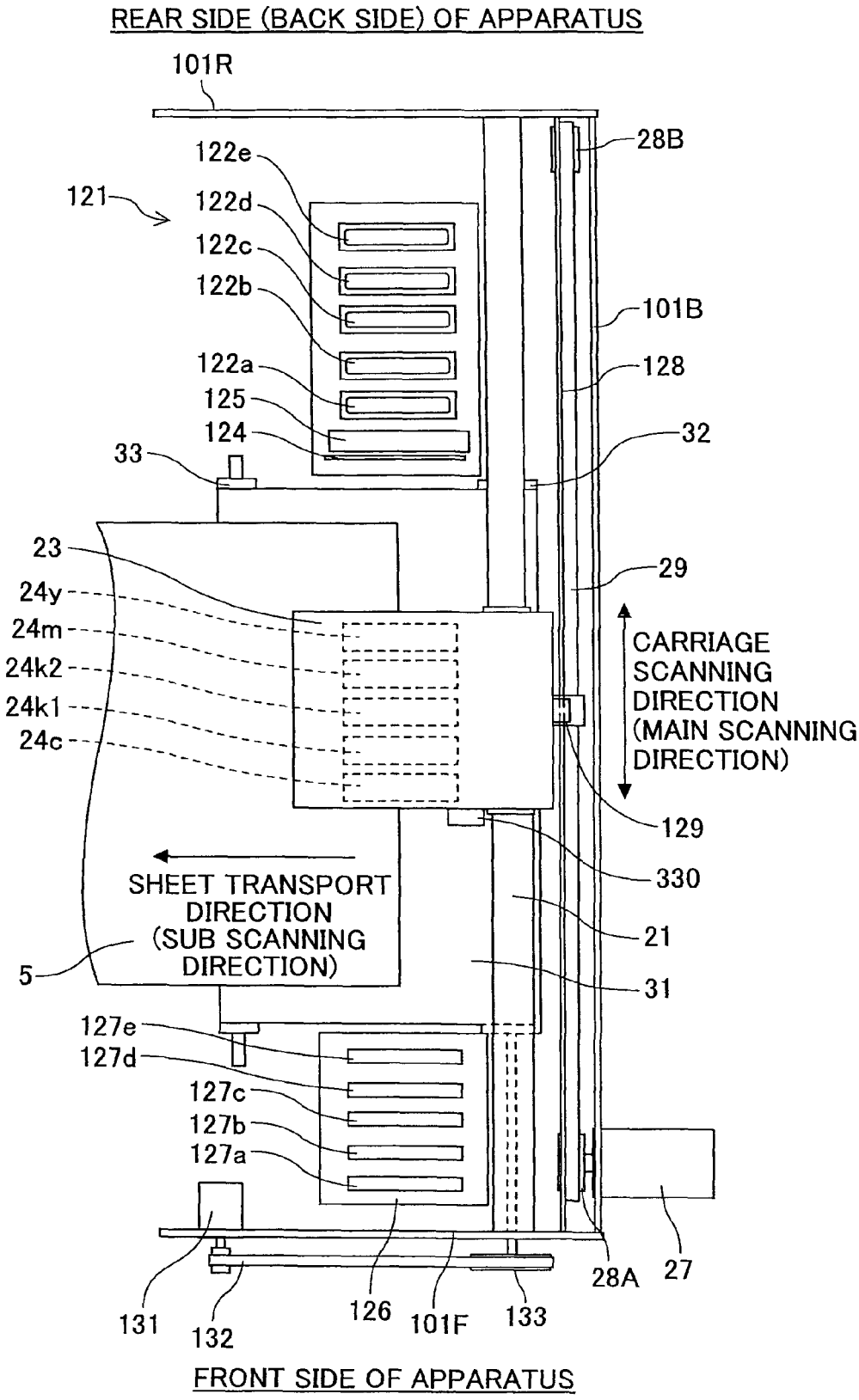
FIG. 2 is a plan view illustrating an image forming unit and a sub scanning transport unit of the image forming apparatus.
Figure 3:
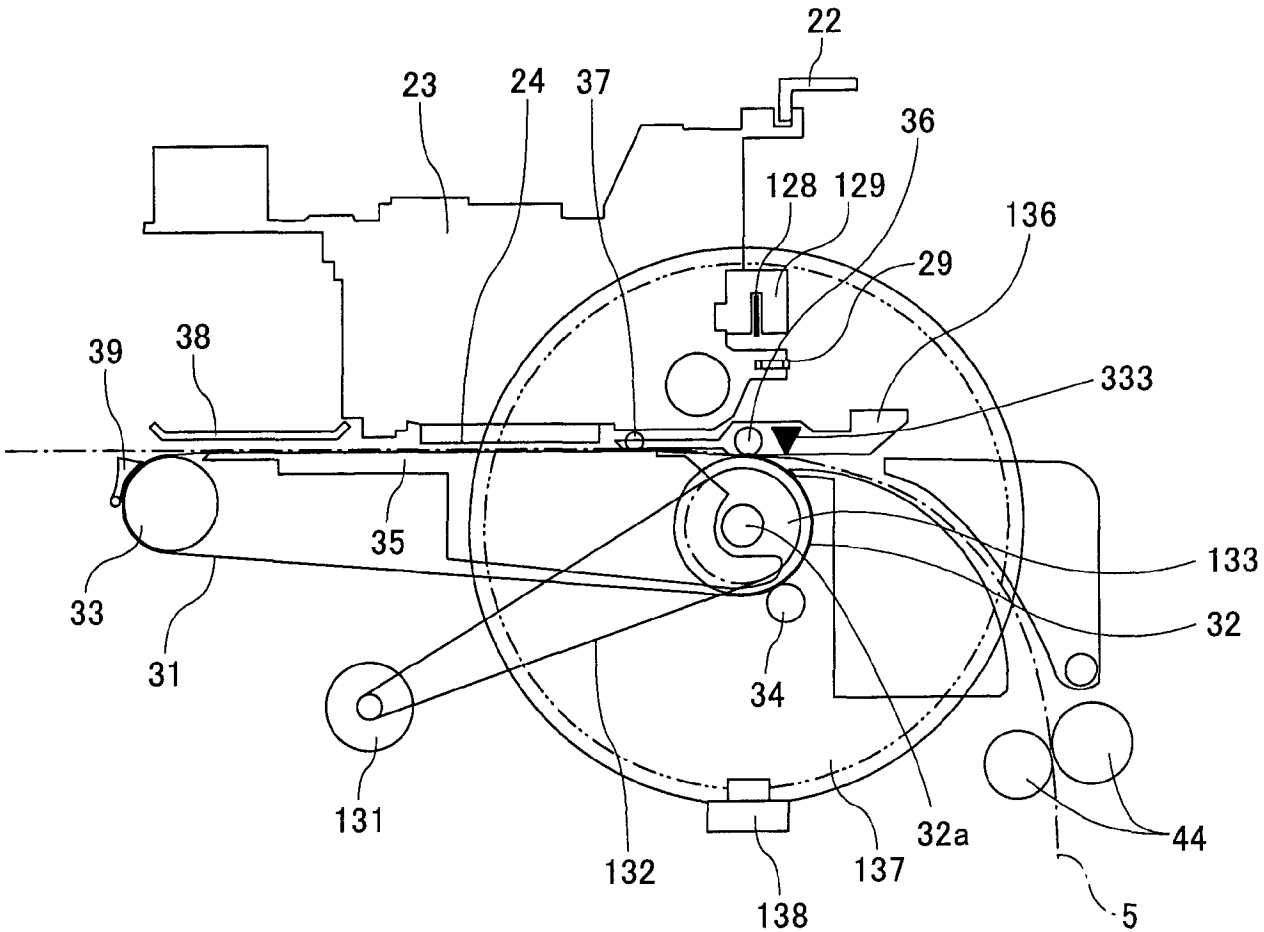
FIG. 3 is a side view illustrating the image forming unit and the sub scanning transport unit.

Exemplary embodiments of the present invention are described below with reference to the accompanying drawings. An example of an image forming apparatus of an embodiment of the present invention is described below with reference to FIGS. 1 through 3. FIG. 1 is a schematic configuration diagram illustrating the image forming apparatus. FIG. 2 is a plan view illustrating an image forming unit 2 and a sub scanning transport unit 3 of the image forming apparatus. FIG. 3 is a side view illustrating the image forming unit 2 and the sub scanning transport unit 3.

The image forming apparatus includes, in an apparatus main body 1, the image forming unit 2 that forms an image on a sheet (recording medium) 5 and the sub scanning transport unit 3 that transports the sheet 5. In the image forming apparatus, sheets 5 are fed one by one from a feed unit 4, which is disposed at the bottom of the apparatus main body 1 and includes a feed cassette 41. The sub scanning transport unit 3 transports the sheet 5 so that the sheet 5 passes through a position facing the image forming unit 2. The image forming unit 2 ejects liquid droplets onto the sheet 5 to form (record) an image. Then, a discharge transport unit 7 discharges the sheet 5 onto a discharge tray 8 on the upper side of the apparatus main body 1.

The image forming apparatus further includes an image reading unit (scanner unit) 11 for scanning images that serves as an image data (print data) input unit for reading image data based on which the image forming unit 2 forms an image. The image reading unit 11 is disposed above the discharge tray 8 in the upper side of the apparatus main body 1. The image reading unit 11 scans an image of the original document placed on a contact glass 12 by moving a first scanning optical unit 15, including a light source 13 and a mirror 14, and a second scanning optical unit 18, including mirrors 16 and 17. The scanned image of the original document is read as image signals by an image scanning element 20 disposed behind a lens 19. The read image signals are digitized and processed into print data to be printed out.

Referring to FIG. 2, in the image forming unit 2 of the image forming apparatus, a carriage 23 is held movably in a main scanning direction by a carriage guide (guide rod) 21 as a main guide member, extending between a front panel 101F and a rear panel 101R, and a guide stay (not shown) as a sub guide member, disposed at the side of a rear stay 101B. The carriage 23 is moved in the main scanning direction by a main scanning motor 27 via a timing belt 29 extending around a drive pulley 28A and a driven pulley 28B.

On the carriage 23 are mounted a total of five recording heads (liquid ejection heads) 24, namely, recording heads 24*k*1 and 24*k*2 for ejecting black (K) ink, a recording head 24*c* for cyan (C) ink, a recording head 24*m* for magenta (M) ink, and a recording head 24*y* for yellow (Y) ink (these recording heads 24*k*1, 24K2, 24*c*, 24*m*, and 24*y* may be referred to as the recording heads 24 when the colors thereof are not referred to). The image forming unit 2 is a shuttle type, which reciprocally moves the carriage 23 in the main scanning direction while ejecting liquid droplets from the recording heads 24 to form an image on the sheet 5 being transported in a sheet transport direction (a sub scanning direction) by the sub scanning transport unit 3.

Referring back to FIG. 1, on the carriage 23 are also mounted sub tanks 25 that supply color recording liquids to the corresponding recording heads 24. Ink cartridges 26 storing black (K) ink, cyan (C) ink, magenta (M) ink, and yellow (Y) ink are detachably attached to a cartridge attachment section (not shown) from the front of the apparatus main body 1. The inks (recording liquids) in the ink cartridges 26 are supplied to the corresponding sub tanks 25 via tubes (not shown). The black ink is supplied from the black ink cartridge 26 to the two black sub tanks 25.

The recording head 24 may be a piezo type that includes a pressure generating unit (actuator unit) and is configured to apply pressure to ink in an ink passage (pressure generating chamber) and deform a wall of the ink passage so as to change the volume of the ink passage, thereby ejecting ink droplets; a thermal type configured to heat the ink in an ink passage using a heating element so as to form bubbles, thereby ejecting the ink with pressure of the bubbles; or an electrostatic type that includes a diaphragm on a wall of an ink passage and an electrode opposing the diaphragm and is configured to deform the diaphragm with static electricity between the diaphragm and the electrode so as to change the volume of the ink passage, thereby ejecting ink droplets.

Referring again to FIG. 2, a linear scale 128 is disposed that extends between the front panel 101F and the rear panel 101R in the main scanning direction of the carriage 23. The carriage 23 is provided with an encoder sensor 129 including a transmissive photo sensor for detecting slits of the linear scale 128. The linear scale 128 and the encoder sensor 129 constitute a linear encoder that detects movement of the carriage 23.

On one side of the carriage 23 is disposed a leading edge detector 330 for detecting the leading edge of the sheet 5 being transported. The leading edge detector 330 detects the leading edge of the sheet 5 being transported downstream of a nip portion between a transport belt 31 (described below) and a pressure roller 36 (described below) in the sheet transport direction.

A maintenance recovery mechanism (device) 121 for maintaining and restoring the condition of nozzles of the recording heads 24 is provided in a non-printing region at one side in the scanning direction of the carriage 23. The maintenance recovery mechanism 121 includes one suction cap 122*a*, serving also as a dry-proof cap, and four dry-proof caps 122*b* through 122*e* for capping nozzle faces 24*a* of the five recording heads 24. The maintenance recovery mechanism 121 further includes a wiper blade 124 for wiping the nozzle faces 24*a* of the recording heads 24, and an idle ejection receiver 125 for idle ejection. Another idle ejection receiver 126 for idle ejection is disposed in a non-printing region at the other end in the scanning direction of the carriage 23. The idle ejection receiver 126 includes openings 127*a* through 127*e*.

Referring also to FIG. 3, the sub scanning transport unit 3 includes the endless transport belt 31 extending around a transport roller 32 as a drive roller and a driven roller 33 as a tension roller and is configured to change a transport direction of the sheet 5, which is fed from the lower side, by 90 degrees so that the sheet 5 faces the image forming unit 2 and transport the sheet 5 facing the image forming unit 2; a charging roller 34 as a charger that charges the surface of the transport belt 31 with a high voltage (alternating current) supplied from a high-voltage power supply; a guide member 35 that guides the transport belt 31 within an area opposing the image forming unit 2; the pressure roller 36, disposed to oppose the transport roller 32, and a leading edge pressure roller 37 that are rotatably supported by a support member 136 and are configured to press the sheet 5 against the transport belt 31; a guide plate 38 that presses the upper surface of the sheet 5 with an image formed by the image forming unit 2; and a separation claw 39 that separates the sheet 5 with an image formed from the transport belt 31. An entrance detector 333 as a sheet detector for detecting the sheet 5 being transported is disposed upstream the nip portion between the transport belt 31 and the pressure roller 36 in the sheet transport direction, and an exit detector (not shown) for detecting the sheet 5 is disposed downstream the separation claw 39.

The transport belt 31 is rotated to transport the sheet 5 in the sheet transport direction (sub scanning direction) when the transport roller 32 is rotated through a timing belt 132 and a timing roller 133 by a sub scanning motor 131 using a DC brushless motor.

A code wheel 137 of high resolution is attached to a shaft 32*a* of the transport roller 32. An encoder sensor 138 including a transmissive photo sensor for detecting slits (not shown) is formed in the code wheel 137. The code wheel 137 and the encoder sensor 138 form a rotary encoder.

The feed unit 4 includes the feed cassette 41 that is removable from the apparatus main body 1 and capable of storing a large number of sheets 5 in a stack, a feed roller 42 and a friction pad 43 for feeding the sheets 5 one by one, and a pair of registration rollers 44 for registration of the fed sheet 5.

The feed unit 4 includes a manual feed tray 46 capable of storing a large number of sheets 5 in a stack, a manual feed roller 47 that feeds the sheets 5 one by one from the manual feed tray 46, a vertical transport roller 48 that transports the sheet 5 fed from another feed cassette (not shown), which can be optionally attached to the lower side of the apparatus main body 1, or fed from a duplexing unit (not shown). Rollers for feeding the sheet 5 to the sub scanning transport unit 3, such as the feed roller 42, the pair of registration rollers 44, the manual feed roller 47, and the vertical transport roller 48, are driven by a feed motor (drive unit) 49, which is an HB stepping motor, via an electromagnetic clutch (not shown).

The discharge transport unit 7 includes three arrays of transport rollers 71*a*, 71*b*, and 71*c* (also referred to as transport rollers 71) arranged in the sheet transport direction and configured to transport the sheet 5 separated by the separation claw 39 of the sub scanning transport unit 3; three arrays of spurs 72*a*, 72*b*, and 72*c* (also referred to as spurs 72) facing the transport rollers 71*a*, 71*b*, and 71*c*, respectively; a pair of reverse rollers 77 for reversing the sheet 5; and a pair of reverse discharge rollers 78 configured to output the sheet 5 with its face down onto the discharge tray 8. This transport path is referred to as a reverse discharge path. In each of the arrays of the transport rollers 71, plural transport rollers 71 are arranged in the direction (sheet width direction) orthogonal to the sheet transport direction. Similarly, in each of the arrays of the spurs 72, plural spurs 72 are arranged in the direction orthogonal to the sheet transport direction.

As shown in FIG. 1, in the image forming apparatus, a single sheet manual feed tray 141 for manually feeding a single sheet is rotatably attached to one side of the apparatus main body 1. When manually feeding a single sheet, the single sheet manual feed tray 141 is rotated to an open position shown by the two-dotted lines. The sheet 5 that has been manually fed from the single sheet manual feed tray 141 is guided by the upper surface of a guide plate 110 to be inserted straight between the transport roller 32 and the pressure roller 36 of the sub scanning transport unit 3.

A straight discharge tray 181 is rotatably attached to the other side of the apparatus main body 1. The sheet 5 with an image formed is discharged straight ahead, with its face up, onto the straight discharge tray 181. When the straight discharge tray 181 is rotated to an open position shown by the two-dotted lines, the sheet 5 that has been transported by the discharge transport unit 7 can be discharged linearly onto the straight discharge tray 181. This discharge path is referred to as a straight discharge path.

Figure 4:
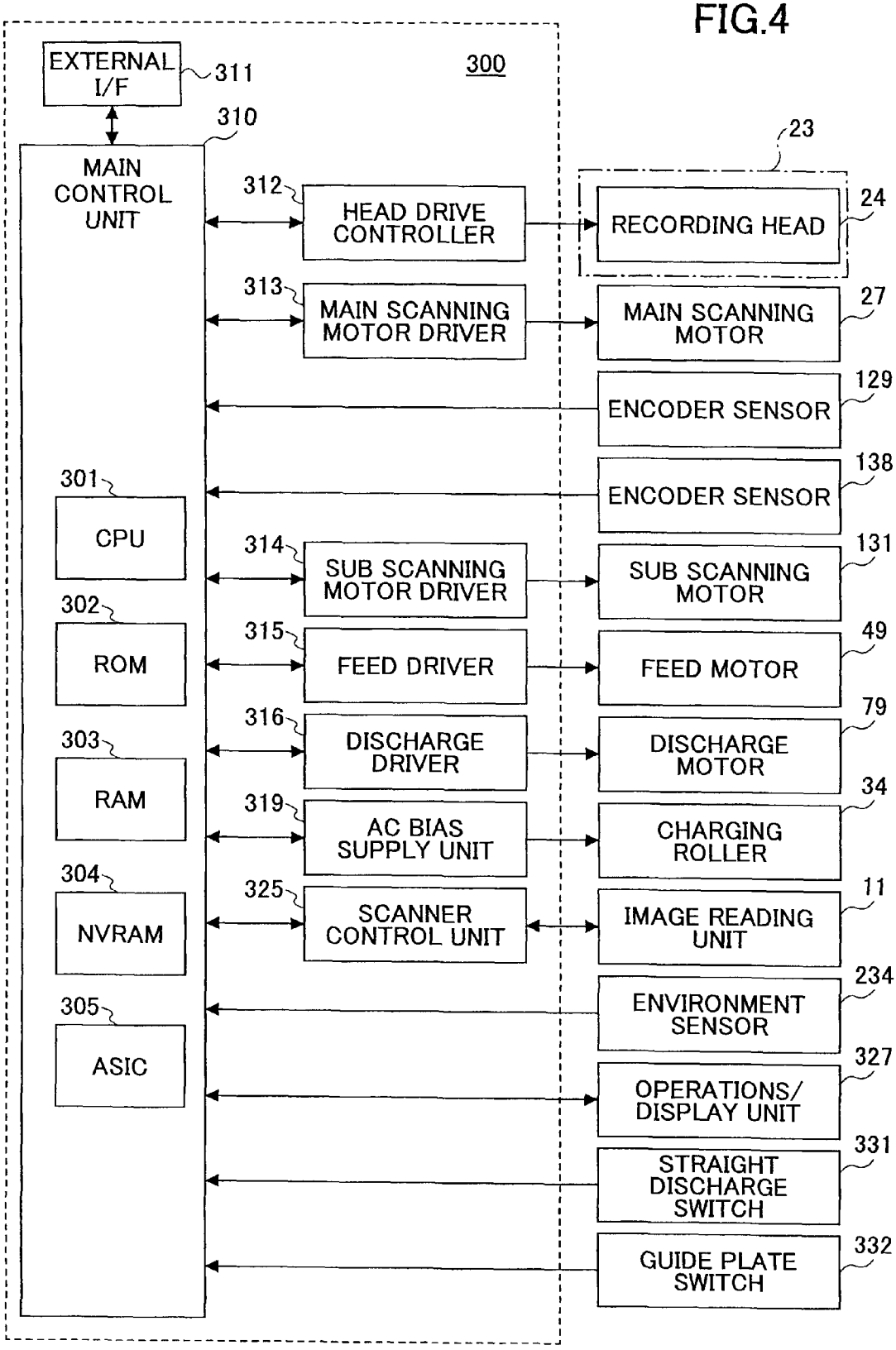
FIG. 4 is a block diagram schematically illustrating a control unit of the image forming apparatus.

An overview of a control unit 300 of the image forming apparatus is described below with reference to FIG. 4.

The control unit 300 includes a main control unit 310 that performs control of the entire image forming apparatus and performs control of an embodiment of the present invention. The main control unit 310 includes a CPU 301, a ROM 302 that stores programs to be executed by the CPU 301 and other fixed data, a RAM 303 that temporarily stores image data, etc., a nonvolatile memory (NVRAM) 304 that retains data even when power is turned off, and an ASIC 305 that processes input/output signals for processing images such as sorting images and for controlling the entire image forming apparatus.

The control unit 300 further includes an external I/F 311 through which signals and data are transmitted to a host device (not shown) from the main control unit 310 and from the host device to the main control unit 310; a head drive controller 312 including a head driver (actually attached to the recording heads 24) that controls and drives the recording heads 24 and includes an ASIC for head data generation sequence conversion; a main scanning motor driver 313 that drives the main scanning motor 27 for moving the carriage 23; a sub scanning motor driver 314 that drives the sub scanning motor 131; a feed driver 315 that drives the feed motor 49; a discharge driver 316 that drives a discharge motor 79 for driving the rollers 71, 77, and 78 of the discharge transport unit 7; an AC bias supply unit 319 that supplies an AC bias to the charging roller 34; a maintenance recovery system driver (not shown) that drives a maintenance recovery motor (not shown) for driving the maintenance recovery mechanism 121; a duplexing unit driver (not shown) that drives the duplexing unit when the duplexing unit is attached; a solenoid driver (not shown) that drives various solenoids (SOLs); a clutch driver (not shown) that drives electromagnetic clutches (not shown); and a scanner control unit 325 that controls the image reading unit 11.

The main control unit 310 receives various detection signals, such as signals from an environment sensor 234 that detects the temperature and humidity (environmental conditions) around the transport belt 31, signals from straight discharge switch (SW) 331 that detects the status of the straight discharge tray 181, and signals from a guide plate switch (SW) 332 as a detector that detects the status of a guide member 200 (described below) of the discharge transport unit 7. The main control unit 310 receives detection signals from various other sensors (not shown). The main control unit 310 receives instructions entered through various keys, such as numeric keys and a print start key, disposed on the apparatus main body 1. The main control unit 310 also receives instructions entered through an operations/display unit 327 and outputs information to be displayed to the operations/display unit 327.

The main control unit 310 also receives an output signal from the photo sensor (encoder sensor) 129 of the linear encoder for detecting the position of the carriage 23, and controls the main scanning motor 27 through the main scanning motor driver 313 based on the output signal so as to reciprocate the carriage 23 in the main scanning direction. The main control unit 310 also receives an output signal (pulse) from the photo sensor (encoder sensor) 138 of the rotary encoder for detecting the amount of the rotation of the transport belt 31, and controls the sub scanning motor 131 through the sub scanning motor driver 314 based on the output signal so as to rotate the transport belt 31 via the transport roller 32.

An image forming operation by the image forming apparatus having the above-described configuration is briefly described below. The amount of rotation of the transport roller 32, which drives the transport belt 31, is detected. The sub scanning motor 131 is controlled according to the detected amount of rotation. The AC bias supply unit 319 applies a bipolar rectangular-wave high voltage as an alternating voltage to the charging roller 34. Thus, the transport belt 31 is alternately positively and negatively charged at predetermined widths in the transport direction of the transport belt 31, thereby forming a non-uniform electric field on the transport belt 31.

When the sheet 5 sent from the feed unit 4 passes through between the transport roller 32 and the pressure roller 36 onto the transport belt 31 on which the non-uniform electric field is generated by positive and negative charges, the sheet 5 is instantaneously polarized along a direction of the electric field and is adhered onto the transport belt 31 due to an electrostatic attraction force. Thus, the sheet 5 is transported along with the movement of the transport belt 31.

The sheet 5 is intermittently transported by the transport belt 31. The recording heads 24 eject droplets of recording liquids onto the stationary sheet 5 to record (print) images while moving the carriage 23 in the main scanning direction. The separation claw 39 separates the leading edge of the printed sheet 5 from the transport belt 31 to transport the sheet 5 to the discharge transport unit 7. The discharge transport unit 7 discharges the sheet 5 onto the discharge tray 8.

The carriage 23 is moved to the side of the maintenance recovery mechanism 121 while standing by for a print (recording) operation. The nozzle faces of the recording heads 24 are capped by the caps 122 for keeping the nozzles wet, thereby preventing poor ejection due to ink dryout. A recovery operation is performed for ejecting thickened recording liquid and bubbles by suctioning the recording liquid from the nozzles of the recording heads 24 capped by the suction cap 122*a* and the dry-proof caps 122*b*-122*e*. The wiper blade 124 wipes the nozzle faces of the recording heads 24 to remove the ink adhering to the nozzle faces 24*a*. Further, before starting a recording operation or during a recording operation, idle ejection is performed not for forming images but for ejecting ink to the idle ejection receiver 125. The idle ejection enables the recording heads 24 to maintain stable ejection performance.

Figure 5:
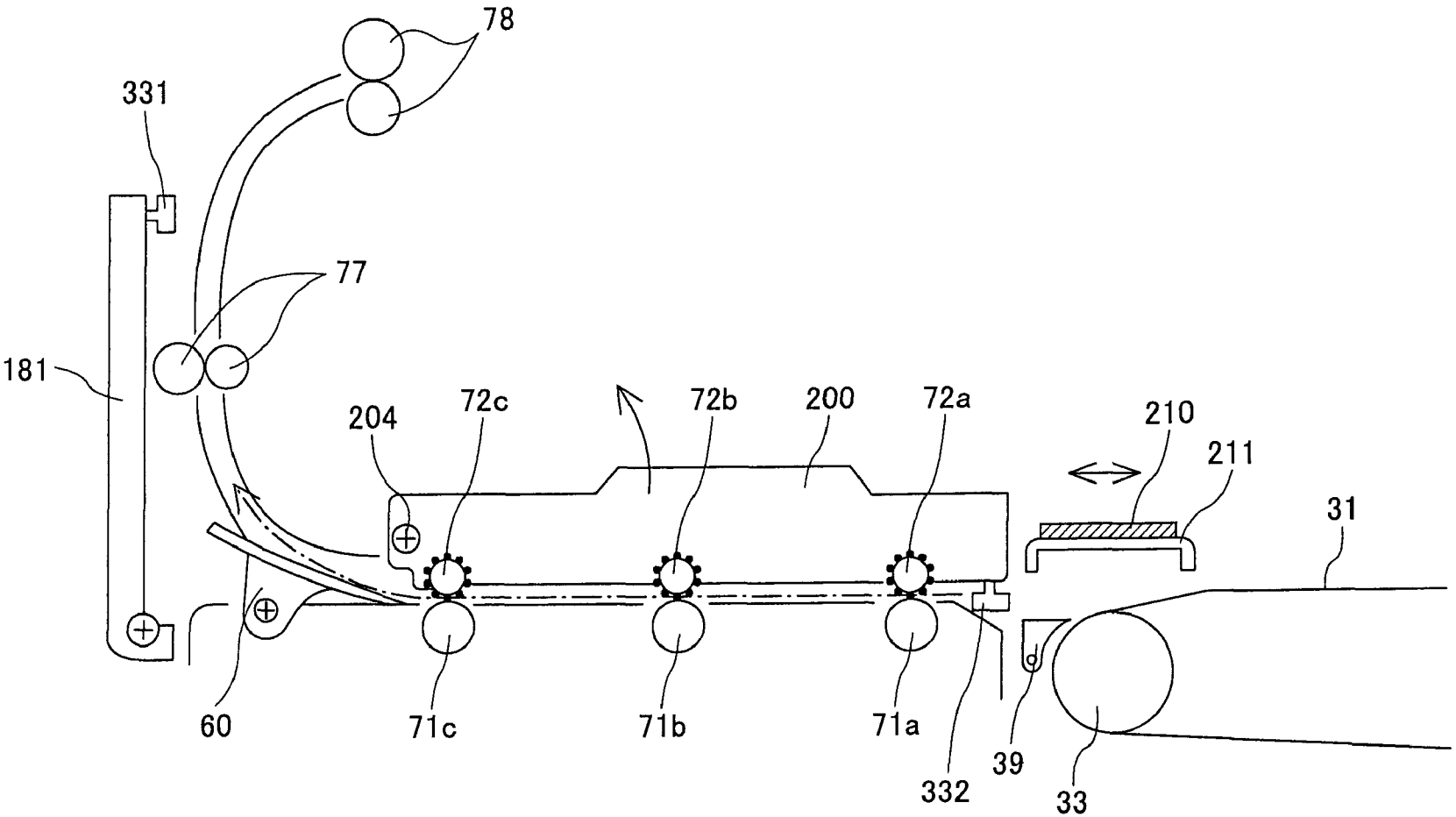
FIG. 5 is a schematic diagram illustrating a transport path including a discharge transport unit.
Figure 6:
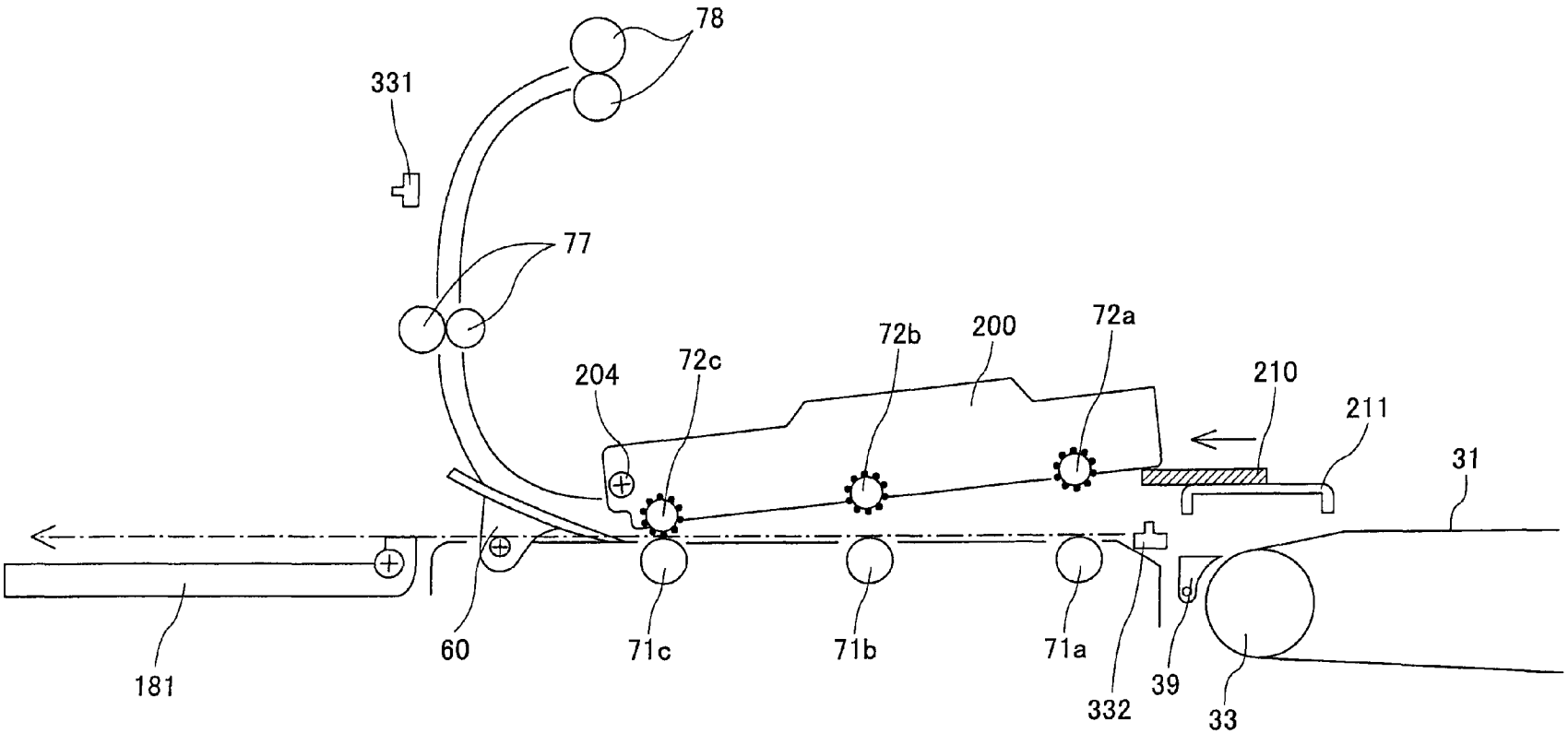
FIG. 6 is a schematic diagram illustrating a guide member of the discharge transport unit stopped and held in a predetermined position.
Figure 7:
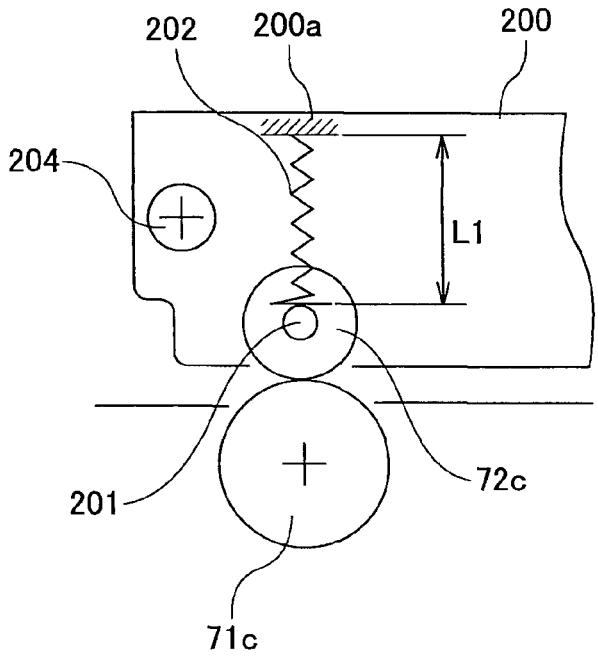
FIG. 7 is a diagram for explaining a pushing force exerted by a spur when the guide member is in a first position.
Figure 8:
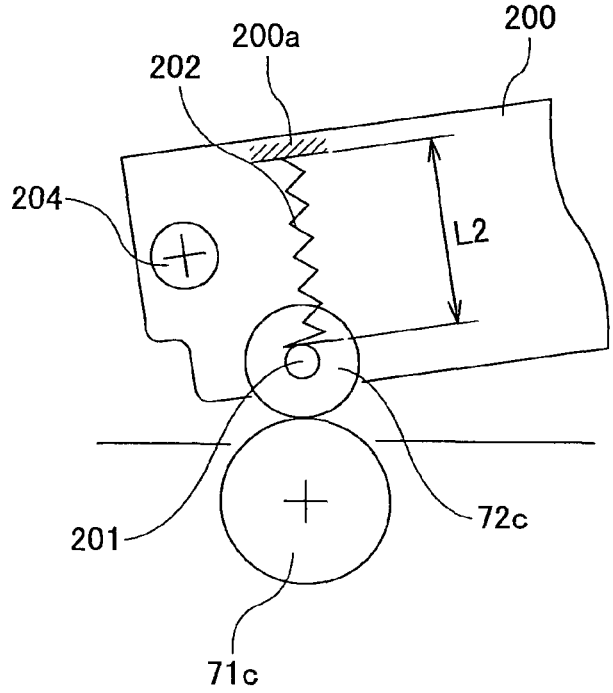
FIG. 8 is a diagram for explaining a pushing force exerted by the spur when the guide member is in a second position.

The discharge transport unit 7 of the image forming apparatus is described below in detail with reference to FIGS. 5 and 6. FIG. 5 is a schematic diagram illustrating a transport path including the discharge transport unit 7. FIG. 6 is a schematic diagram illustrating the guide member 200 of the discharge transport unit 7 stopped and held in a predetermined position. The three arrays of the spurs 72*a*, 72*b*, and 72*c* of the discharge transport unit 7 are held by the guide member 200. As shown in FIGS. 7 and 8, a spring 202 is interposed between an attachment portion inside the guide member 200 and a shaft 201 of each array of the spurs 72 so that each spur 72 is pressed and biased toward the corresponding transport roller 71 with predetermined pressing force (pushing force).

The guide member 200 is rotatably supported by a shaft 204, which is disposed in the most downstream position in the sheet transport direction, and is rotatable between at least a first position shown in FIG. 5 in which the three arrays of the spurs 72*a*, 72*b*, and 72*c* are in contact with the transport rollers 71*a*, 71*b*, and 71*c*, respectively, (i.e., in contact with the sheet 5) and a second position shown in FIG. 6 in which only the spurs 72*c* disposed in the most downstream side in the sheet transport direction are in contact with the corresponding transport rollers 71*c* (i.e., in contact with the sheet 5). The shaft 204 by which the guide member 200 is rotatably supported may alternatively be disposed in the most upstream position, but in that case, additional spurs and transport rollers are required for transporting and discharging the sheet 5.

When the guide member 200 is in the first position in which the three arrays of the spurs 72*a*, 72*b*, and 72*c* are in contact with the transport rollers 71*a*, 71*b*, and 71*c*, respectively, as shown in FIG. 5, the length of the spring 202 that presses and biases the spurs 72*c* is L1 as shown in FIG. 7. On the other hand, when the guide member 200 is in the second position in which only the spurs 72*c* disposed in the most downstream side in the sheet transport direction are in contact with the transport rollers 71*c* as shown in FIG. 6, the length of the spring 202 that presses and biases the spurs 72*c* against the corresponding transport rollers 71*c* is L2 (L2>L1) as shown in FIG. 7.

Accordingly, the pushing force of the spurs 72*c* is about 30% smaller when the guide member 200 is in the second position than when the guide member 200 is in the first position. That is, placing the guide member 200 in the second position reduces white spots in the image due to contact with the spurs 72.

Figure 9A:
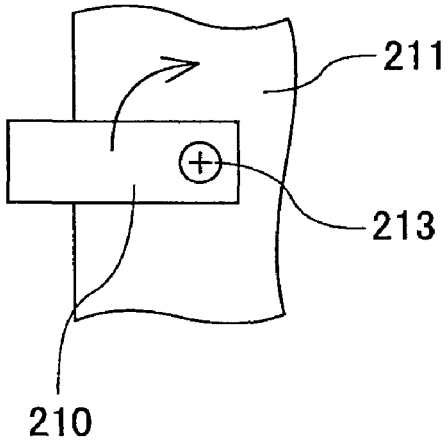
FIGS. 9A and 9B are schematic diagrams illustrating another example of a stopping and holding unit.
Figure 9B:
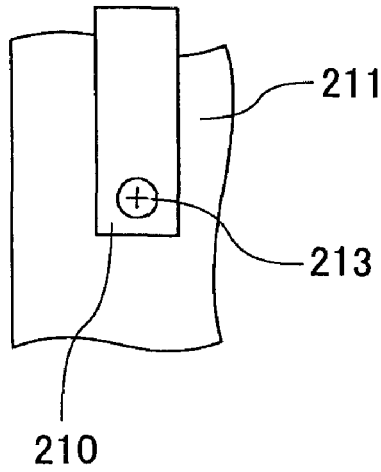

As shown in FIG. 6, a stopper member 210 is disposed upstream the guide member 200 in the sheet transport direction so as to be movable into and out of the rotation region of the guide member 200. The stopper member 210 serves as a stopping and holding unit that stops and holds the guide member 200 in the second position as shown in FIG. 6. In this embodiment, the stopper member 210 is disposed on a support member 211 so as to be linearly movable. However, other configurations are possible. For example, as shown in FIGS. 9A and 9B, the stopper member 210 may be rotatably attached to a shaft 213 on the support member 211 so as to be rotatable into and out of the rotation region of the guide member 200. The stopper member 210 is moved linearly or rotated by manually operating a lever from the outside of the apparatus main body 1, for example.

The guide plate switch 332 for detecting the guide member 200 being in the first position is disposed upstream the guide member 200 in the sheet transport direction. The straight discharge switch 331 detects the straight discharge tray 181 being opened.

Figure 10:
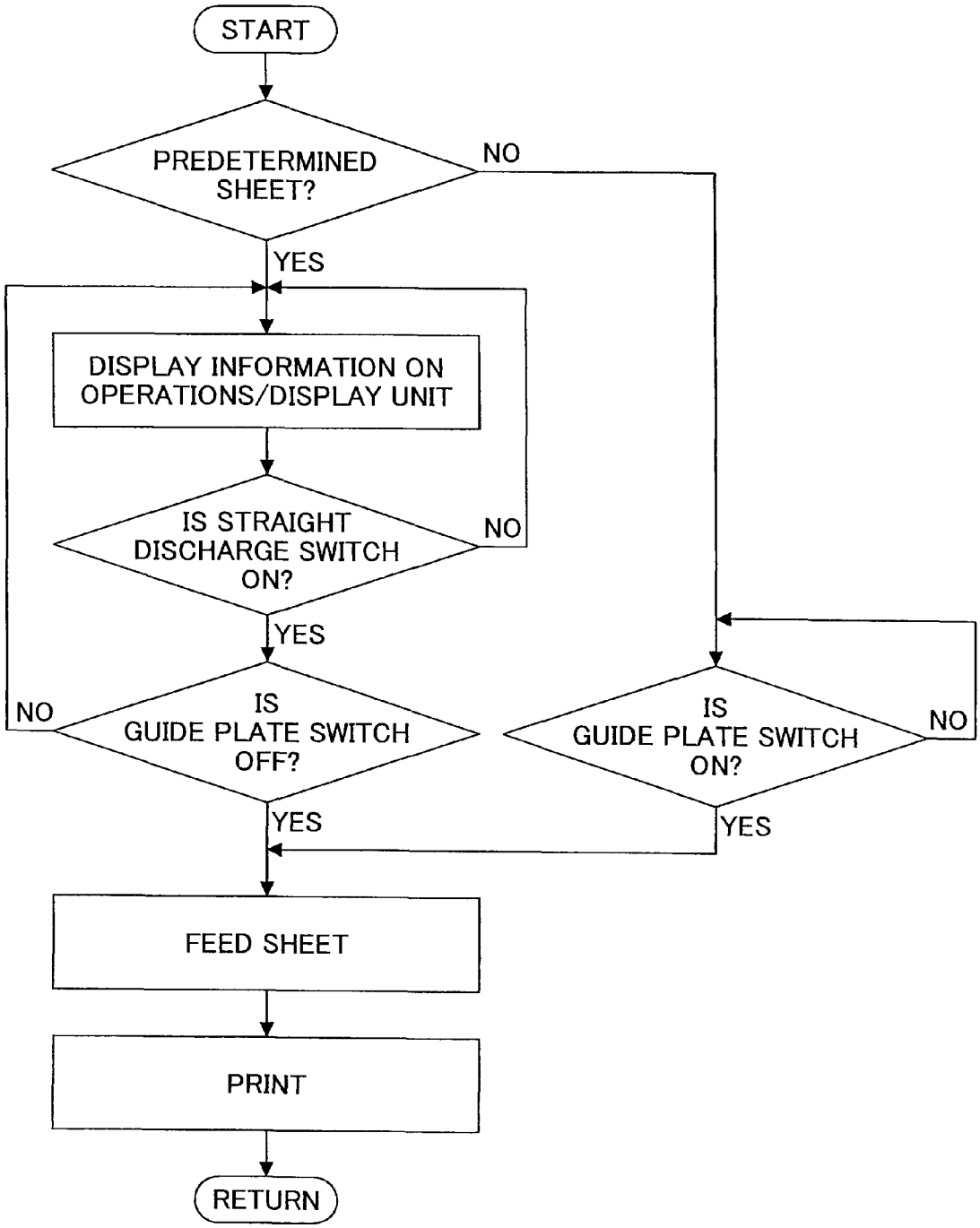
FIG. 10 is a flowchart illustrating a print control operation performed by the control unit.

The following discusses control performed in the case where the above-described discharge transport unit 7 is provided with reference to the flowchart of FIG. 10.

Here, sheets that are to be discharged straight ahead are predetermined. If image formation on a predetermined sheet is selected, the operations/display unit 327 displays information that prompts a user to open the straight discharge tray 181 and rotate the guide member 200 of the discharge transport unit 7 to the second position. For example, the operations/display unit 327 displays a message "Please open the straight discharge tray. Please open the guide member and set the stopper".

Then, it is determined whether the straight discharge switch 331 is turned on (whether the straight discharge tray 181 is opened). If the straight discharge switch 331 is turned on, it is determined whether the guide plate switch 332 is turned off (whether the guide member 200 is rotated to the second position). If the guide plate switch 332 is on, an image formation operation is put in a standby state and does not start until the guide plate switch 332 is turned off.

When the straight discharge tray 181 is opened and the guide member 200 is rotated to the second position, sheet feeding is started to start printing.

In this way, if a sheet to be discharged straight ahead is used, the sheet is transported for discharge with its image formation surface being pressed by only one array of the spurs 72*c* disposed in the most downstream side in the sheet transport direction. Therefore, even if spur traces are formed on the sheet, the spur traces are less noticeable. When discharging a sheet straight ahead as in this case, since the required transporting force is smaller than the transporting force required in the case of reversing and discharging the sheet, it is possible to transport the sheet using only the spurs 72*c* disposed in the most downstream side in the sheet transport direction. Further, since only the spurs 72*c* disposed in the most downstream side in the sheet transport direction are used to press the sheet, there is no need to provide additional spurs for discharging the sheet.

If a predetermined sheet is not selected, it is determined whether the guide plate switch 332 is on (whether the guide member 200 is in the first position). If the guide plate switch 332 is off, an image formation operation is put in a standby state and does not start. If the guide plate switch 332 is on, an image formation operation starts.

In this way, in the case of reversing a sheet and discharging the reversed sheet, since the discharge transport unit 7 is required to provide a great transporting force, image formation does not start unless the guide member 200 is in the first position in which the three arrays of the spurs 72*a*-72*c* are in contact with the corresponding transport rollers 71*a*-71*c*. This prevents jamming due to transportation with insufficient force.

Experimental results are described below with reference to FIGS. 11A-12B. Note that although spur traces were white in the experiments, they are shown in black in the drawings for clarity.

Figure 11A:
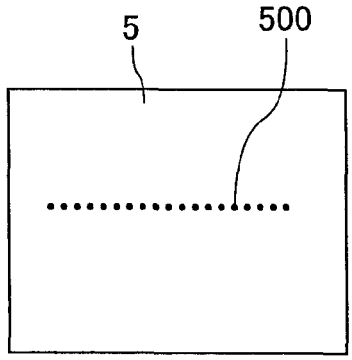
FIGS. 11A and 11B are diagrams for explaining spur traces formed when image formation is performed with the guide member in the first position.
Figure 11B:
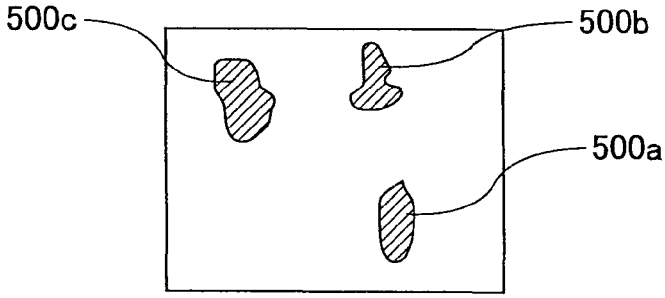

First, an image with high image density (e.g., a solid image) was printed on a sheet while the guide member 200 was placed in the first position such that the sheet was pressed by the three arrays of the spurs 72. Then, as shown in FIG. 11A, spur traces 500 were formed in the sheet transport direction. FIG. 11B shows an enlarged view of one of the spur traces 500. As shown in FIG. 11B, three spur traces 500*a*-500*c* form the spur trace 500. The spur traces 500*a*-500*c* are formed at small pitch (e.g., a 0.2 mm pitch) and therefore visually appear like a single spot. This makes the spur traces 500 noticeable.

Figure 12A:
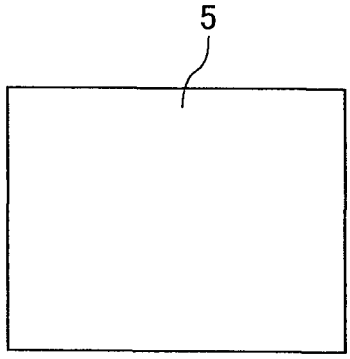
FIGS. 12A and 12B are diagrams for explaining spur traces formed when image formation is performed with the guide member in the second position.
Figure 12B:
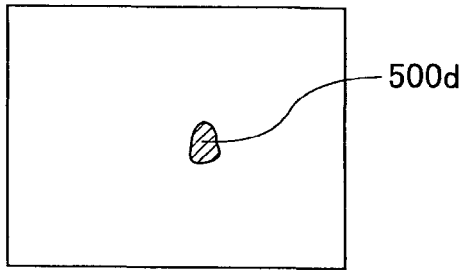

Next, an image with high image density (e.g., a solid image) was printed on a sheet while the guide member 200 was placed in the second position such that the sheet was pressed by only one array of the spurs 72*c* that is disposed in the most downstream side. Then, as shown in FIG. 12A, no visible spur traces were observed on the sheet. As shown enlarged in FIG. 12B, however, there was actually one spur trace 500*d*. But, since there was only one spur trace 500*d* and the spur trace 500*d* was small due to reduction of the reduced pressing force (pushing force) of the spurs 72*c*, no visible spur traces were observed on the sheet.

As described above, the image forming apparatus includes the guide member 200 configured to hold the spurs 72 of the discharge transport unit 7 and be rotatable about a most downstream side or a most upstream side in the sheet transport direction to rotate in a direction away from a sheet transport path and the stopping and holding unit 210 configured to stop and hold the guide member 200 in a position in which only the spurs 72*c* in the most downstream side in the sheet transport direction are in contact with the sheet. Therefore, in the case of forming an image on which noticeable spur traces tend to be formed, the number of spurs that come into contact with the sheet can be reduced. Thus, although plural spurs are arranged in the sheet transport direction, it is possible to make spur traces less noticeable.

In the above embodiments, the guide member 200 is configured to be manually rotated, and the stopping and holding unit 210 is configured to be manually moved into and out of a stopping and holding position (i.e., a position for holding the guide member 200 in the second position). However, other configurations are possible. For example, the guide member 200 may be configured to be rotated a predetermined amount by a drive source, such as a motor. Thus, it is possible to rotate the guide member 200 to the second position by driving the drive source and to stop and hold the guide member 200 in the second position by stopping the guide driving source. In this case, the driving source for rotating the guide member 200 also serves as the stopping and holding unit.

The present application is based on Japanese Priority Application No. 2007-316166 filed on Dec. 6, 2007, with the Japanese Patent Office, the entire contents of which are hereby incorporated herein by reference.

What is claimed is:

1. An image forming apparatus, comprising:

a recording head configured to eject liquid droplets onto a sheet to form an image;

a transport unit configured to intermittently transport the sheet so that the sheet is transported facing the recording head;

a discharge transport unit disposed downstream the transport unit in a sheet transport direction, the discharge transport unit including:

plural transport rollers configured to transport, independently from the transport unit, the sheet in a sheet discharge direction; and plural spurs disposed facing the respective transport rollers and arranged in the sheet transport direction;

a guide member configured to hold the spurs of the discharge transport unit and be rotatably supported by a shaft to rotate in a direction away from a sheet transport path;

a stopping and holding unit configured to stop and hold the guide member in a position in which only the spur in the most downstream side in the sheet transport direction is in contact with the sheet; and a detecting unit configured to detect the guide member being in a position in which the plural spurs are in contact with the sheet.

2. The image forming apparatus as claimed in claim 1, wherein the stopping and holding unit is a movable member that is movable into and out of a rotation region of the guide member.

3. The image forming apparatus as claimed in claim 1, wherein the stopping and holding unit is a rotatable member that is rotatable into and out of a rotation region of the guide member.

4. The image forming apparatus as claimed in claim 1, further comprising a spring interposed between an attachment portion inside the guide member and a shaft of a specific one of the spurs and configured to provide a predetermined pressing force to press and bias the specific spur toward the corresponding transport roller.

5. An image forming apparatus, comprising:

a recording head configured to eject liquid droplets onto a sheet to form an image;

a transport unit configured to intermittently transport the sheet so that the sheet is transported facing the recording head;

a discharge transport unit disposed downstream the transport unit in a sheet transport direction, the discharge transport unit including:

plural transport rollers configured to transport, independently from the transport unit, the sheet in a sheet discharge direction; and plural spurs disposed facing the respective transport rollers and arranged in the sheet transport direction;

a guide member configured to hold the spurs of the discharge transport unit and be rotatable about a most downstream side in the sheet transport direction to rotate in a direction away from a sheet transport path;

a stopping and holding unit configured to stop and hold the guide member in a position in which only the spur in the most downstream side in the sheet transport direction is in contact with the sheet; and a detecting unit configured to detect the guide member being in a position in which the plural spurs are in contact with the sheet.

6. The image forming apparatus as claimed in claim 5, further comprising:

a reverse discharge path configured to reverse the sheet and discharge the reversed sheet; and a straight discharge path configured to discharge the sheet straight ahead;

wherein if image formation on a sheet to be discharged through the straight discharge path is selected, image formation does not start as long as the guide member is in the position in which the plural spurs are in contact with the sheet, based on the detection result of the detecting unit.

7. The image forming apparatus as claimed in claim 5, further comprising a shaft rotatably supporting the guide member and disposed in a most downstream position in the sheet transport direction, wherein the guide member is rotatable between at least a first position at which the spurs are in contact with the respective transport rollers, and a second position at which only the spur disposed in the most downstream side in the sheet transport direction is in contact with the corresponding transport roller.

8. The image forming apparatus as claimed in claim 5, wherein the detecting unit is disposed upstream the guide member in the sheet transport direction.

9. An image forming apparatus, comprising:

a recording head configured to eject liquid droplets onto a sheet to form an image;

a transport unit configured to intermittently transport the sheet so that the sheet is transported facing the recording head;

a discharge transport unit disposed downstream the transport unit in a sheet transport direction, the discharge transport unit including:

plural transport rollers configured to transport, independently from the transport unit, the sheet in a sheet discharge direction; and plural arrays of spurs disposed facing the respective transport rollers and arranged in the sheet transport direction;

a straight discharge tray configured to be selectably opened and closed;

a straight discharge path configured to discharge the sheet onto the straight discharge tray;

a guide member configured to hold the plural arrays of spurs of the discharge transport unit and configured to be rotatably supported by a shaft to rotate in a direction away from a sheet transport path;

another discharge tray disposed downstream of the guide member in the sheet transport direction;

a reverse discharge path configured to discharge the sheet with an image formation surface of the sheet facing down onto said another discharge tray; and a stopping and holding unit configured to move the guide member from a first position to a second position and stop and hold the guide member in the second position in which only one of the plural arrays of spurs that is in the most downstream side in the sheet transport direction is in contact with the sheet, wherein when the sheet is to be transported through the straight discharge path, the guide member is positioned at the second position, and the sheet is transported for discharge with the image formation surface of the sheet being pressed by only said one of the plural arrays of spurs, and when the sheet is to be transported through the reverse discharge path, the guide member is positioned at the first position, and the sheet is transported with the plural arrays of spurs.

10. The image forming apparatus as claimed in claim 9, wherein the stopping and holding unit sets the guide member in the first position or the second position to switch between the reverse discharge path and the straight discharge path.

11. The image forming apparatus as claimed in claim 9, wherein the sheet is discharged linearly through the straight discharge path onto the straight discharge tray.

12. The image forming apparatus as claimed in claim 9, wherein when the straight discharge tray is open and the guide member is in the first position, image formation operation is maintained in a standby state until the guide member is moved to the second position.

13. The image forming apparatus as claimed in claim 9, wherein when the straight discharge tray is closed and the guide member is in the second position, image formation operation is maintained in a standby state until the guide member is moved to the first position.

* * * * *